United States Patent [19]

Powell, Jr.

[11] 4,198,726

[45] Apr. 22, 1980

[54] TRAVELING PNEUMATIC CLEANER FILTER

[75] Inventor: Benjamin S. Powell, Jr., Charlotte, N.C.

[73] Assignee: Parks-Cramer Company, Fitchburg, Mass.

[21] Appl. No.: 52,866

[22] Filed: Jun. 28, 1979

Related U.S. Application Data

[63] Continuation-in-part of Ser. No. 900,248, Apr. 26, 1978, abandoned.

[51] Int. Cl.[2] ..... A47L 7/00

[52] U.S. Cl. ..... 15/312 A; 55/337; 55/486; 55/492; 55/501; 55/509; 55/525

[58] Field of Search ..... 15/312 R, 312 A; 55/336, 337, 426, 428, 459 R, 521, 525, 486, 489, 492, 501, 509

[56] References Cited

U.S. PATENT DOCUMENTS

| | | | |
|---|---|---|---|
| 2,242,278 | 5/1941 | Yonkers | 55/521 X |
| 2,322,110 | 6/1943 | Bock | 55/521 X |
| 2,977,181 | 3/1961 | Reiterer | 15/312 A X |
| 3,245,103 | 4/1966 | King | 15/312 A |
| 3,320,727 | 5/1967 | Farley et al. | 55/337 |
| 3,343,344 | 9/1967 | Fairaizl et al. | 55/521 X |
| 3,437,520 | 4/1969 | Black | 55/337 X |
| 3,618,302 | 11/1971 | Cornett | 55/337 X |

*Primary Examiner*—Christopher K. Moore

*Attorney, Agent, or Firm*—Bell, Seltzer, Park & Gibson

[57] ABSTRACT

An improvement in a traveling pneumatic cleaner for vacuum collection of fiber waste from a textile mill room in the form of a filter disposed in a receptacle for separating fiber waste from an air current passing through the receptacle. The filter defines a surface of revolution, preferably taking the form of a substantially conical foraminous surface about a central axis of the receptacle, and so arranged relative to the receptacle that the air current will be directed around the filter and then through the same with the velocity of the air current being diminished and lowered as it passes through the filter. Optionally, the filtering may be augmented by a foam filter medium cooperating with the foraminous surface.

18 Claims, 9 Drawing Figures

TRAVELING PNEUMATIC CLEANER FILTER

CROSS REFERENCE TO RELATED APPLICATION

This application is a continuation-in-part of my copending application Ser. No. 900,248, filed Apr. 26, 1978 now abandoned, and entitled TRAVELING PNEUMATIC CLEANER FILTER.

BACKGROUND OF THE INVENTION

Traveling pneumatic cleaners for collecting fiber waste from textile mill rooms have achieved substantial acceptance in the textile industry and have been effective in substantially reduced labor requirements in such mill rooms while improving product quality and the work environment. Examples of such traveling pneumatic cleaners may be found in U.S. Pat. Nos. 3,188,680 and 3,437,520 issued June 15, 1965 and Apr. 8, 1969 and owned in common with the present invention. The success achieved by traveling pneumatic cleaners such as those shown in these prior patents has arisen at least in part from their gathering textile fiber waste and retaining such waste in a receptacle from which waste is periodically removed.

With the substantial improvement in cleanliness of textile mill rooms which has been achieved by using traveling pneumatic cleaners, the standards of cleanliness desired for a mill room have consistently become more stringent. That is, the marked improvement in overall cleanliness of a textile mill room resulting from the use of traveling pneumatic cleaners of the type described has made more apparent the presence in the room of fine particles of waste material. While receptacles and filters for such receptacles as described in the aforementioned related prior patents have been successful in achieving this result, the increasingly more stringent requirements desired to be met by operators of textile mills have brought attention to the fine particles of waste material which pass through the filter screens provided in the traveling pneumatic cleaners shown by the prior patents. It is believed that such passage of fine particles, now being noticed, results at least in part from relatively high air velocity carrying waste through the filter screens and/or from beating and scrubbing of waste against the filter screens. Prior filter arrangements offer no known workable solution to this problem in this environment.

SUMMARY OF THE INVENTION

In light of the development of the applicable art of cleaning textile mill rooms and the difficulties now encountered, it is an object of the present invention to aid in reducing the discharge into the room of fine particles of waste materials. In realizing this object of the present invention, the velocity of air flowing through the filter of a fiber waste accumulation receptacle forming a portion of a traveling pneumatic cleaner is reduced. Such reduction of air velocity decreases the possibility of carrying fine particles of waste through the filter. More particularly, the effective or face area of the filter is enlarged by using a filter of a particular configuration. With such enlargement of the face area, the volume of air which must be moved through the receptacle may pass through the surface of the filter at a lower velocity (herein sometimes referred to as the "face velocity").

Yet a further object of the present invention is to provide within a fiber waste receptacle, which is carried by and communicates with the fan housing of a traveling pneumatic cleaner, a substantially conical filter means positioned in the receptacle and so arranged that a fiber laden air current entering the receptacle passes around the conical surface of the filter means while the velocity of the air current is diminished and lowered to aid in the reduction of discharge of fine particles from the cleaner.

According to a preferred embodiment of the invention, the filter means comprises a perforate or foraminous generally conical body which extends inwardly from an open air-discharge end of a generally cylindrically-shaped fiber waste receptacle, with the conical wall of the filter means preferably formed of a thin, rigid material, such as sheet metal, having at least a major portion thereof provided with closely spaced, tiny perforations therethrough.

In a modified embodiment of the invention, to aid further in the retention of very small or submicron fiber particles within the fiber waste receptacle, a resilient, spongy and porous foam filter medium, serving as a secondary filter, is matingly positioned within the thin-walled conical filter body and preferably is positioned against the conical wall thereof so as to entirely cover the same such that the air current passes through the foam filter medium in its course to and through the open air-discharge end of the receptacle, the rigid conical wall thus also serving as a supporing retainer for the foam filter medium.

BRIEF DESCRIPTION OF THE DRAWINGS

Some of the objects of the invention having been stated, other objects will appear as the description proceeds, when taken in connection with the accompanying drawings, in which.

DETAILED DESCRIPTION

Figure 1:
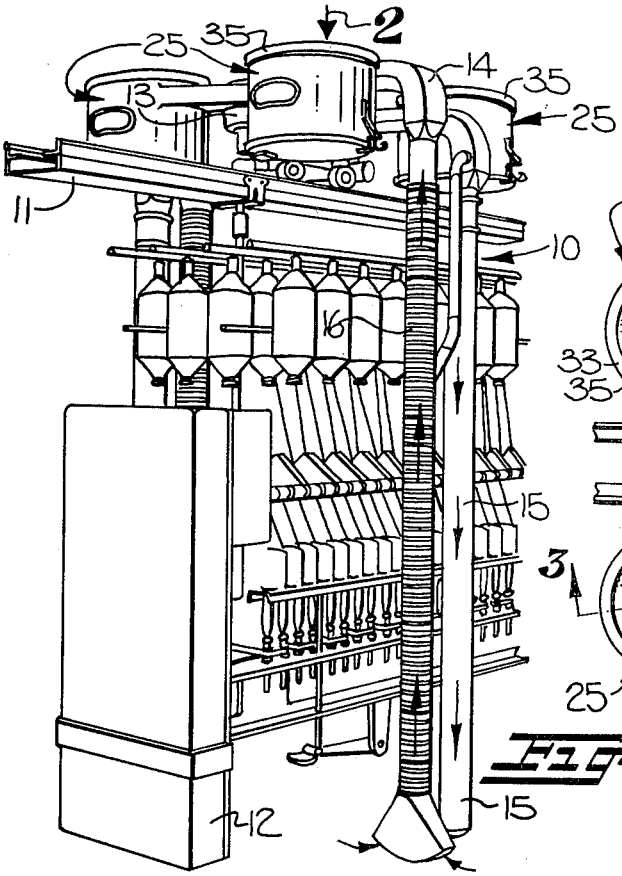
FIG. 1 is a perspective view of an overhead track mounted traveling pneumatic cleaner in association with a textile processing machine, and embodying the improved waste receptacle means of the present invention.
Figure 2:
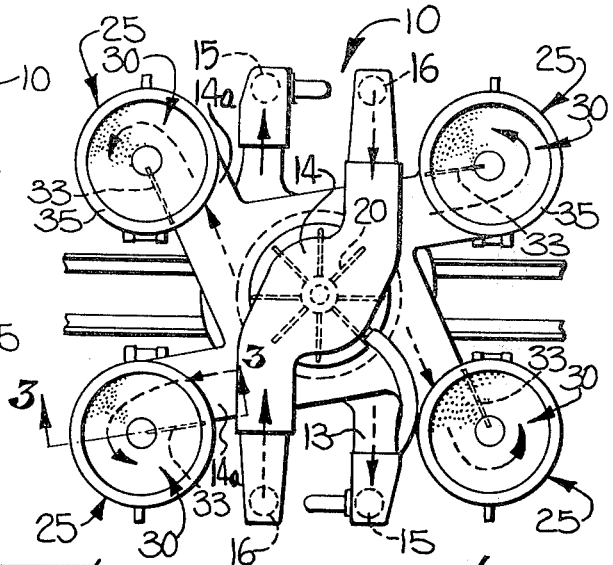
FIG. 2 is a top plan view of the traveling pneumatic cleaner of FIG. 1.

Referring more specifically to the drawings, the traveling pneumatic cleaner embodying the present invention is generally designated at 10 in FIGS. 1 and 2, and it is mounted for travel along an overhead track 11 extending over and along a row or rows of textile processing machines 12, as represented by a spinning machine in FIG. 1. The traveling cleaner may be substantially of the type disclosed in U.S. Pat. Nos. 3,188,680 and 3,437,520, dated June 15, 1965 and Apr. 8, 1969, respectively, and to which reference is made for a more detailed and specific disclosure of the traveling cleaner and its general function.

Generally, the traveling pneumatic cleaner 10 comprises an overhead-track-mounted suction blower unit including a blower housing means 13 and a suction housing means 14 positioned one above the other. The blower housing means 13 and the suction housing means 14 have respective flexible blowing and suction tubes 15, 16 communicating therewith, through respective air outlets and air inlets, and depending therefrom for traversing the textile machines 12 and the adjacent floor areas.

Driven rotary fan means 20 in the housing means produces blowing air currents through the blower housing means 13 and in the blowing tubes 15, which are provided with suitable outlets for blowing fiber waste off the machine parts and the textile material in process on the machines 12. The fan means 20 also induces flow of suction air currents through the suction housing means 14 and in the suction tubes 16 for entraining fiber waste from the floor and adjacent areas of the textile mill room in the suction air currents and conveying such fiber waste into receptacle means comprising generally cylindrical, somewhat elongated receptacles 25 carried by and communicating with an air discharge side of the suction housing means 14. In the disclosed and preferred embodiment of the traveling pneumatic cleaner, the housing means is shown provided with four of the receptacles 25, which may be circularly arranged about the rotational axis of fan means 20. However, it is apparent that a greater or lesser number of receptacles 25 may be employed, as desired. Since all the receptacles 25 may be of substantially the same construction, only one of them will be described in detail, with particular reference to FIGS. 3 and 4. The description above has particular reference to a dual or so-called "two air" system. It is contemplated, however, that this invention is also applicable to a single or "one air" system.

Figure 3:
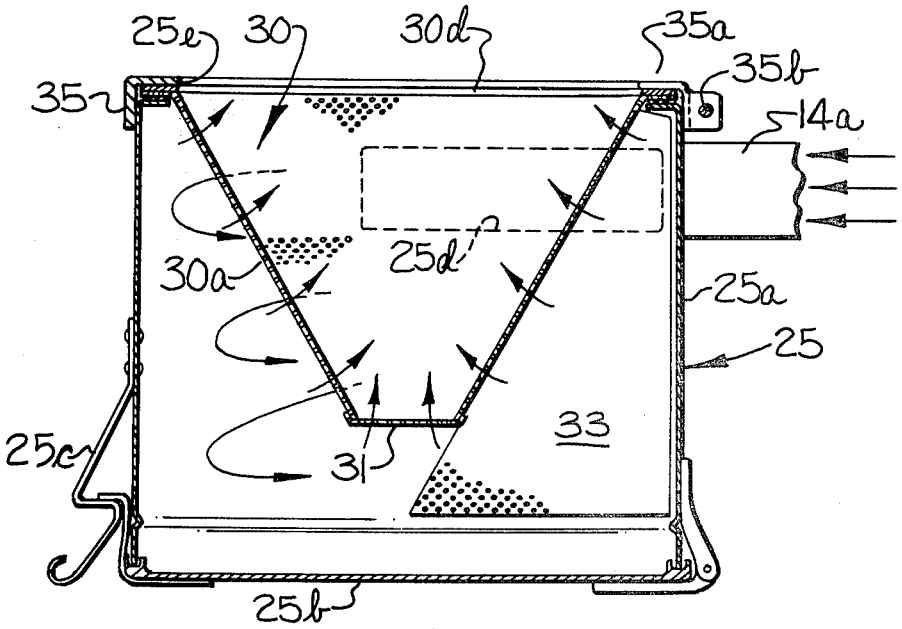
FIG. 3 is an enlarged fragmentary vertical sectional view through one of the improved fiber waste collection receptacles taken substantially along line 3—3 in FIG. 2.
Figure 4:
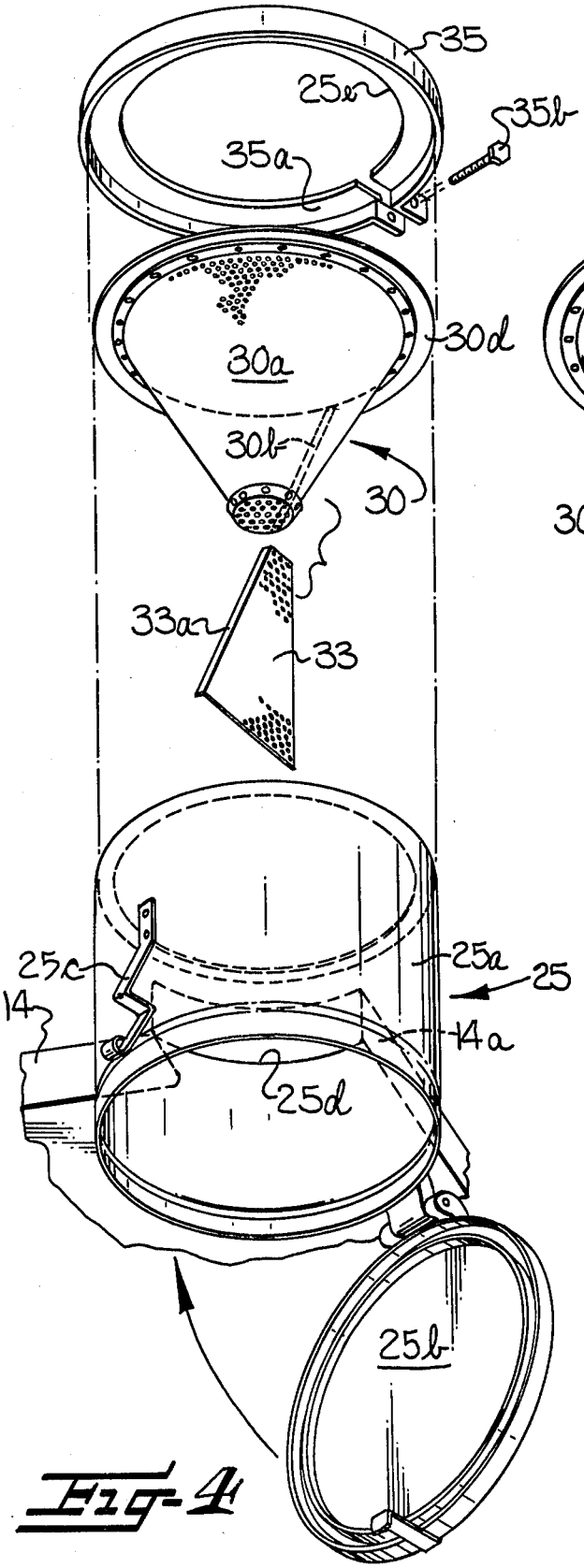
FIG. 4 is a vertically exploded view of the receptacle of FIG. 3, but showing the bottom door means thereof in an open position.

As shown, each receptacle 25 may take the form of a substantially cylindrically-shaped cannister having a substantially vertically disposed cylindrical wall **25*a* whose open bottom defines a waste discharge opening closable by a suitable hinged access door means 25*b*. Door means 25*b* may be latched in the closed position of FIG. 3, as by a latch means 25*c*, during normal operation of the traveling pneumatic cleaner 10. When desired, door means 25*b* may be opened, as shown in FIG. 4**, for removal of collected material from the receptacle.

The housing means is provided with air outlet portions **14*a* for the respective receptacles 25. Each air outlet portion 14*a* serves to direct an air current of air stream through an opening 25*d* in the respective cylindrical wall 25*a* into an upper portion of the respective receptacle 25 and in a direction offset laterally with respect to the substantially vertical axis of the receptacle 25, or in other words, in a substantially tangential manner, so that as the fiber-laden air stream is directed into receptacle 25 from the respective outlet portion 14*a* and through the opening 25*d*, the air stream impinges on the curved inside surface of the cylindrical wall 25*a* (FIG. 3) and is directed thereby in a generally circular or spiral path around the inside of the curved wall of the receptacle 25. The curved path of the air stream within receptacle 25 produces a cyclonic effect or an area of reduced pressure in the central portion of the respective receptacle 25, and this causes the material carried by the air stream to migrate into the lower central portion of the receptacle 25 where the lower central portion of the receptacle 25** where the material is collected.

It is apparent that the air stream entering each receptacle 25 must be exhausted therefrom as fiber waste previously entrained in the air stream is separated therefrom and collected in the corresponding receptacle 25. Heretofore it has been customary, as disclosed in said U.S. Pat. Nos. 3,188,680 and 3,437,520, to provide a suitable filter screen in the top and/or side wall of the cylindrical fiber waste receptacle for permitting the air current to pass through the receptacle to the ambient for collecion of the fiber waste in the respective receptacle.

Such prior art arrangements of the filter or filters in a fiber waste collection receptacle have performed their intended function quite acceptably and have contributed to quite satisfactory operation of the associated traveling pneumatic cleaner as used heretofore. However, as indicated earlier herein, not only is it desirable to dispose of fiber waste generated by the material in process in the textile mill room, but it is important to the comfort and health of persons working in the mill room that any devices used for collecting the fiber waste be so designed as to discharge as little as possible of the fiber waste or fine particles thereof back into the atmosphere of the mill room.

According to the present invention, each of the receptacles 25 is provided with improved filter means which minimizes interference with the movement of the air current through the respecitve receptacle 25 while aiding in reduction of discharge of fine particles from the receptacle; i.e., only a minimum of fine particles of the fiber waste being collected may escape from the receptacle. Accordingly, it will be observed in FIG. 3 that the receptacle 25 there shown has a relatively large opening **25*e* in its upper end, or such upper end may be entirely open, providing communication therethrough with a generally conical filter means 30 extending within receptacle 25 and which thus provides a relatively enlarged surface area for passage of the air currents therethrough so that the velocity of air flowing through the filter means 30 is reduced. Stated otherwise, the filter means 30 defines a surface of revolution so arranged relative to the receptacle and the housing means 13, 14 that the air current entering the receptacle will be directed around the outer surface of the filter means 30** and then through the filter means with the velocity of the air current being diminished and lowered as it passes through the filter means.

As shown, in the first embodiment of the invention (see FIGS. 3, 4 and 5), the generally conical filter means 30 includes a body **30*a* preferably formed from thin foraminous or perforate, rigid sheet material, such as sheet metal. The filter body 30*a* may be of intact conical configuration (terminating at a point), or as shown, it may be of frusto-conical configuration with its smaller, lower, end facing downwardly and terminating a substantial distance above the horizontal plane of the lower edge of the cylindrical wall 25***a* of the receptacle 25 so as to provide adequate space within the receptacle 25 for collection of the fiber waste therein. The truncated lower end of filter body 30*a* may be closed by any suitable closure means, such as a foraminous filter disc or plate 31 suitably attached to filter body 30*a*. It is contemplated that the filter may take the form of other surfaces of revolution about the central axis of the receptacle, although a cone is preferred.

To provide a desired enlarged surface area for the filter means 30, as compared to the usable area defined by the opening 25*e* in the upper end of the receptacle 25, the filter body 30*a* of the filter means 30 should have its larger end as large as is practicable with respect to the open upper end of the receptacle 25, and the filter body 30*a* may define an included angle of about 50 to 70 degrees. It is apparent that the enlarged surface area of the body 30*a* of the filter means 30 provides for passage of the air current through the receptacle 25 at a reduced or lowered velocity, so as to facilitate avoidance of carry-through of fine particles. Such enlarged surface area of the filter means 30 also permits the use of relative smaller interstices or perforations in the filter means, as compared to the size of the interstices or perforations which might otherwise be necessary to accommodate the desired volume of air flowing therethrough.

By way of example, it has been determined that the filter body 30*a* may be provided with a multiplicity of tiny, closely spaced, perforations therethrough (approximately 0.020 to 0.025 inch or 0.50 to 0.64 mm in diameter, for example) such that fine particles in the fiber waste being collected do not pass through the generally conical filter means 30. This phenomenon results in a relatively rapid build-up of fibers on the upstream surface of the filter body 30*a*, following any manual cleaning of the filter body, such as to provide a thin layer or blanket of fibers adhering to the upstream surface of the filter body 30*a* to further aid in filtering fine particles of fiber waste out of the air current before it passes outwardly through the conical filter means 30 and back into the mill room.

Figure 5:
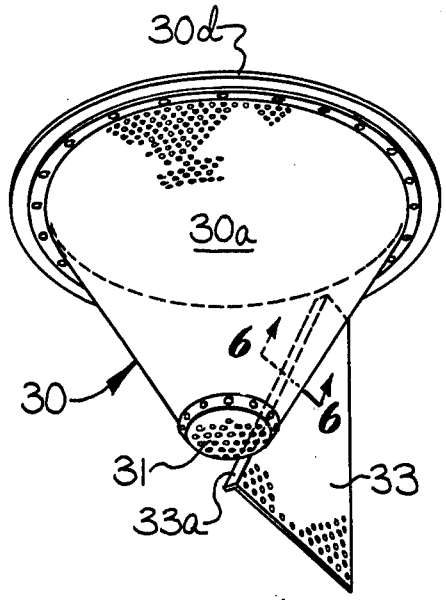
FIG. 5 is a perspective view of the improved filter means and an associated baffle means in assembled relation, but removed from the receptacle.

To aid further in directing and controlling the air current around the body 30*a* of conical filter means 30, it is preferred that a baffle means 33 (FIGS. 3–6) be provided extending substantially radially between the body 30*a* of the filter means 30 and the cylindrical wall 25*a* of receptacle 25, adjacent and downstream of the outlet 13*a* (FIG. 2). Baffle means 33 may be formed of any suitable relatively thin, imperforate or perforate sheet material, such as sheet metal, and is shown in FIGS. 3–5 as being of generally triangular configuration so as to extend generally radially and substantially entirely across the corresponding space between the frustoconical filter body 30*a* and the wall 25*a* of the respective receptacle 25. As shown in FIG. 3, baffle means 33 may extend along substantially the entire length of and beyond the smaller lower end of the filter body 30*a*, but the lower edge of the baffle means may be spaced above the door means 25*b* when such door means occupies its closed position. It is preferred that the baffle means 33 is positioned adjacent or substantially in alignment with that side of the corresponding outlet portion 14*a* of suction housing means 14 which is most closely aligned radially of the axis of the respective receptacle 25, so as to control or limit the cyclonic air current therewithin.

Preferably, the filter means 30 and baffle means 33 are of such construction as to readily facilitate storing and/or transporting groups of the filter means in nesting relation prior to installing individual filter means 30 and corresponding baffle means 33 in respective fiber waste collection receptacles 25. This may be particularly desirable in instances in which previously existing traveling pneumatic cleaners of the type discussed earlier herein are to be modified in accordance with the teachings of this invention.

Figure 6:
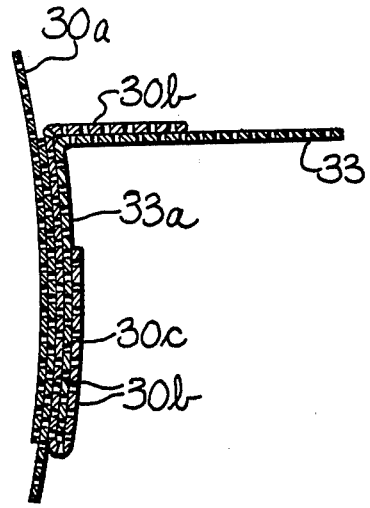
FIG. 6 is an enlarged fragmentary, inverted sectional plan view taken substantially along line 6—6 in FIG. 5 and showing a preferred means for attaching the baffle means to the filter means.

Accordingly, as best shown in FIGS. 4–6, the body 30*a* and baffle means 33 are detachably interconnected. To this end, the frusto-conical body 30*a* of the filter means 30 there shown has an elongate baffle retaining means or attaching strip 30*b* formed integral therewith or suitably secured to the outer surface thereof and extending longitudinally thereof. Strip 30*b* may be formed of any suitable sheet material, such as stainless steel, and is shown in FIG. 6 as being substantially L-shaped in cross-section. That leg of the attaching strip 30*b* attached to filter body 30*a* may be folded over itself to form therein an elongate channel 30*c* for slideably and frictionally receiving and retaining therein a lateral flange 33*a* extending along and preferably formed integral with the adjacent inner or hypotenuse longitudinal edge of the baffle means 33.

Thus, it can be appreciated that, by deferring the assembling of baffle means 33 with the respective filter bodies 30*a* during production of the same, a worker may stack a plurality of the filter means 30 in nesting relationship for the storing or transportation of the same. However, a corresponding baffle means 33 may be readily attached to each frusto-conical filter body 30*a* at any time after they are manufactured. To facilitate installation of a conical filter means 30 and a respective baffle means 33 in each respective receptacle 25, the relatively large, open, upper end of each filter body 30*a* may be readily fitted to the open upper end of a respective receptacle 25. Thus, each filter body 30*a* has a radially outwardly projecting and substantially flat annular flange 30*d* suitably secured thereto or formed integral therewith. Additionally, the upper wall of each receptacle may take the form of a removable split clamping ring 35 having an upper or substantially horizontal annular flange 35*a* thereon (FIGS. 3 and 4) defining the aforementioned upper end opening 25*e* in the receptacle 25.

Accordingly, prior to installing the respective clamping ring 35 on the upper end of a receptacle 25, it can be appreciated that a worker may readily install a filter means 30 and a baffle means 33 in a corresponding previously constructed receptacle 25 simply by inserting the smaller end of the filter body 30*a* into the open upper end of the receptacle 25 to where the upper annular flange 30*d* on the frusto-conical body 30*a* may seat against the upper end of the receptacle cylindrical wall 25*a*. Thereafter, the clamping ring 35 may be positioned on the upper end of the cylindrical wall 25*a* with the flange 35*a* of the clamping ring 35 overlying the flange 30*d* of the filter means 30 and also overlying the upper end of the cylindrical wall 25*a* and thereby securing the conical filter means 30 in the receptacle 25 as best shown in FIG. 3. The clamping ring 35 may be tightened around the upper end of the cylindrical wall 25*a* by any suitable fastening means, such as a bolt 35*b* (FIG. 4). An alternative to the clamping ring 35, as a means for attachng filter means 30 to a receptacle 25 will be later described with reference to FIGS. 7–9.

After the frusto-conical filter body 30*a* has been inserted into the respective receptacle 25 in substantially the manner heretofore described, a worker may insert the baffle means 33, with its narrow or smaller end first, through the open bottom end of the receptacle 25 and into the receptacle 25 while inserting the lateral flange 33*a* of the baffle means 33 in the channel 30*c* of the retaining means 30*b* to thereby frictionally retain the baffle means 33 in assembled relation with the respective frusto-conical filter body 30*a* of the filter means 30.

From the foregoing description, it can be seen that a traveling pneumatic cleaner 10 is provided for vacuum collection of fiber waste from a mill room, which traveling cleaner is equipped with receptacle means including one or more receptacles 25 each having therewithin a filter means 30 defining a surface of revolution so arranged relative to the receptacle 25 and the housing means 13, 14 that the air current entering the receptacle will be directed around the outer surface of the filter means 30 and then through the filter means with the velocity of the air current being diminished and lowered as it passes through the filter means. In the described embodiment, it can also be seen that the filter means 30 comprises a substantially conical or frusto-conical, foraminous or perforate, filter body 30*a* whose larger end is connected with the air-discharge or exhaust opening of the receptacle 25. The filter body 30*a* defines an enlarged conical surface within, and extending about the substantially central axis of, the receptacle 25 so as to present an enlarged surface area for the passage of the air current through the filter means 30 and the receptacle 25 to aid in effecting the diminished and lowered velocity of the air current so as to readily separate fiber waste from the air current flowing through the receptacle 25 and the filter means 30 to the ambient.

In practice, it has been found that the filter means 30 as described above is highly efficient in the removal of fine fibers, picked up by the traveling cleaner, from the air current. In some mills, especially those which process cotton fibers and/or blends thereof with synthetic fibers, it is desirable to further improve the filtering by filtering out microscopic or submicron fiber particles from the air current flowing through the fiber waste receptacle.

Figure 7:
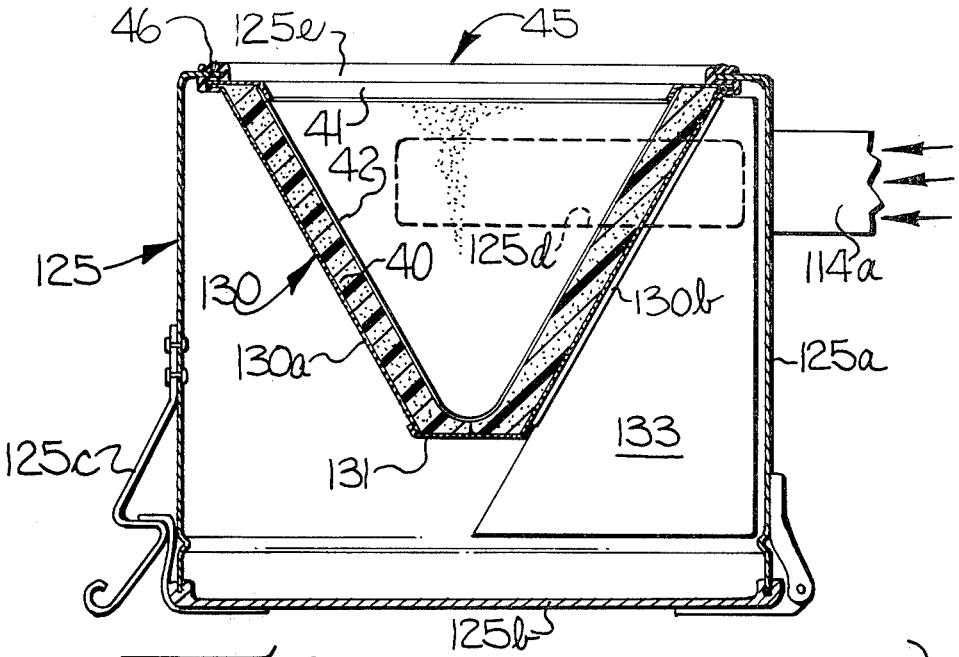
FIG. 7 is a vertical sectional view similar to FIG. 3, but showing a modified form of the fiber waste receptacle in which a porous elastomeric foam filter medium is supported within the substantially conical body of the filter means.
Figure 8:
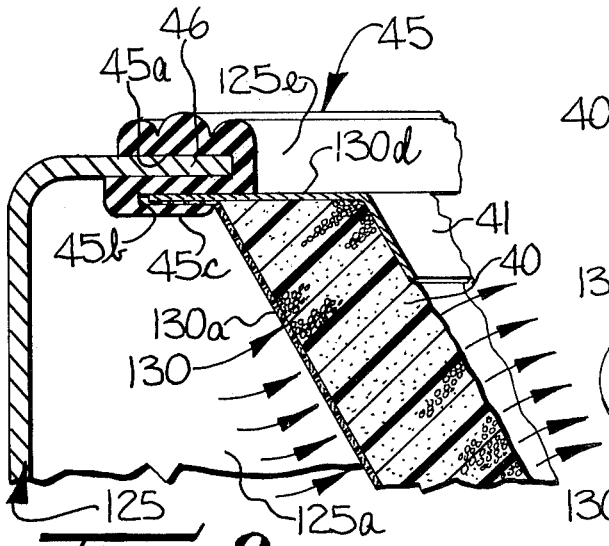
FIG. 8 is an enlarged fragmentary view of the upper left-hand portion of the receptacle and filter means as viewed in FIG. 7.
Figure 9:
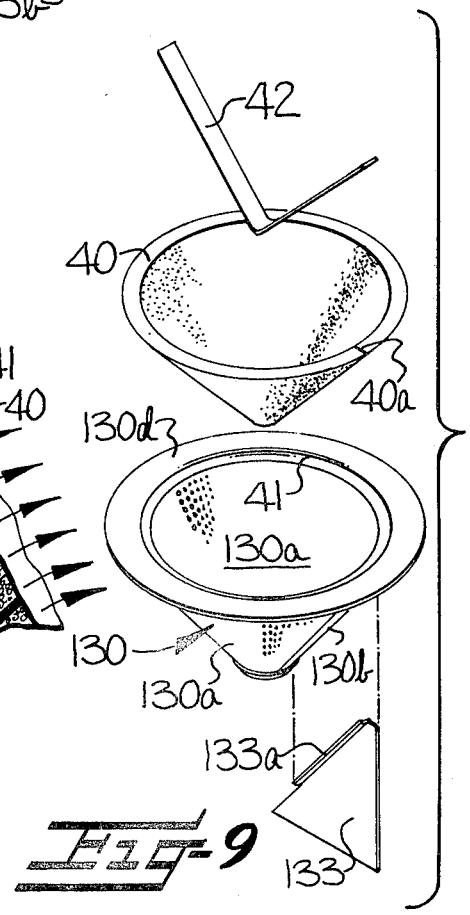
FIG. 9 is an exploded perspective view of the filter means of FIGS. 7 and 8 removed from the receptacle.

Accordingly, a modified form of the invention is shown in FIGS. 7–9 incorporating therein a porous elastomeric foam filter medium for filtering very fine submicron particles as well as the larger fiber waste particles out of the air current passing through the fiber waste receptacle. Since the modified form of receptacle means and its filter means of FIG. 7–9 are generally similar to the first-described form shown in FIGS. 1–6, those parts shown in FIGS. 7–9 which are generally similar to parts shown in FIGS. 1–6 will bear the same reference characters with the prefix "1" added thereto to avoid repetitive description.

Referring now to FIGS. 7–9 more in detail, it will be observed that the porous foam filter medium is designated at 40, and when in use, the filter medium is positioned within the rigid thin-walled conical filter body 130*a*, thus serving as a secondary filter. As shown, and as is preferred, the foam filter medium 40 is quite thick (preferably about one inch or 2.54 centimeters thick) and it is positioned in mating relation to and against the downstream surface of the conical wall of the filter body 130*a* so that the foam filter medium 40 may entirely cover the downstream surface of the filter body wall and the filter body wall thus will serve as a supporting means for the foam filter medium 40 while aiding in maintaining the foam filter medium in a substantially conical or frust-conical configuration as shown in FIGS. 7 and 9.

The material of which the foam filter medium is made should preferably be relatively soft and spongy and of such porosity as to permit the air current to pass therethrough in its course through the receptacle 125 to the ambient virtually unimpeded, but while retaining very small or submicron fiber particles within the fiber waste receptacle 125. By way of an unlimiting example, a foam material which has been found to be well suited as the foam filter medium 40 is a polyether filter foam material having a porosity of about sixty pores per inch and being generally of a type such as is commonly used in an air cleaner associated with the carburetor of an internal combustion engine. Such a foam material may be readily distorted and crushed manually without being damaged by the user, and the foam material has such recoverability that it will quickly return to the form in which it was molded or shaped when it is released.

Therefore, to releasably retain the foam filter medium 40 in the generally conical body 130*a* of the filter means 130, the annular flange 130*d* on the larger or upper end of filter body 130*a* extends inwardly (FIG. 8) from the upper extremity of the filter body 130*a* and has a downwardly extending annular lip portion 41 thereon which is spaced radially inwardly from the perforate wall of the filter body 130*a* a distance about the same as that of the thickness of the foam filter medium 40 so that, after an operator has inserted the conically shaped foam filter medium 40 into the filter body 130*a* substantially as shown in FIGS. 7 and 8, the operator need merely tuck the upper end portion of the foam filter medium 40 under the lip 41 to thereby removably attach the larger end portion of the foam filter medium 40 to the thin-walled substantially conical filter body 130*a*.

The foam filter medium 40 may be of preformed generally conical configuration, as best shown in FIG. 9, so as to be self-sustaining in such configuration when removed or disassociated from the substantially conical body 130*a*. For example, the foam filter medium 40 may be formed by cutting the same from a flat sheet of foam filter material and then adhesively or otherwise securing opposite edges of the sheet together to form a seam 40*a* therein which extends generally longitudinally of the substantially conical filter medium 40 and holds the same in the desired shape. It is apparent that a quantity of conical filter media, such as that shown in FIGS. 7 and 9, may be conveniently stored and/or transported in stacked nesting relationship, if desired.

To further aid in retaining the foam filter medium 40 in the filter body 130*a*, while permitting easy removal of the foam filter medium 40 from the substantially conical filter body 130*a*, an elongate relatively narrow leaf spring member 42 may be employed which may be substantially straight or curved somewhat at its medial portion when it is not in use and is in a relaxed condition, but which may be readily bent intermediate its ends and pushed downwardly by an operator against the inner, upper, surface of the smaller end of the substantially conically shaped foam filter medium 40 to cause the outer surface thereof to bear against the closure member 131 as in FIG. 7, after which the free, then upper, ends of the leaf spring member 42 may be inserted beneath the upper flange 130*d* and between the proximal surfaces of the lip portion 41 thereon and the foam filter medium 40. When the leaf spring member 42 is installed, one of its branches or legs may overlie the seam 40*a*, if desired.

The filter means 130 may be mounted on and attached to the receptacle 125 in essentially the same manner as that described herein with respect to filter means 30 and receptacle 25 in FIGS. 3 and 4. Alternatively, however, the mounting means of the modified form of the invention shown in FIGS. 7 and 8 may be used, wherein it will be observed that an annular elastomeric retaining ring 45 is attached to the open upper end of receptacle 125 in lieu of the clamping ring 35.

The retaining ring 45 may be formed of an extruded strip of natural or synthetic rubber, such as Neoprene, and is provided with an outwardly facing groove 45*a* and an inwardly facing groove 45*b* on radially opposite sides thereof. The retaining ring 45 is positioned in the open upper end of the receptacle 125 with the usual inturned flange 46 on the upper end of the cylindrical wall 125*a* of the receptacle 125 fitting within the groove 45*a* in the outer periphery of the retaining ring 45. Thus, the inner periphery of the retaining ring 45 defines the upper end air-discharge or exhaust opening 125*e* in the receptacle 125. Also, since the elastomeric retaining ring 45 is in substantially airtight engagement with flange 46, it serves as a gasket between the receptacle wall flange 46 and the flange 130*d* on the open upper end of the substantially conical filter body 130*a*.

In this regard, it will be observed in FIG. 8 that the groove 45*b* in the inner periphery of retaining ring 45 is positioned beneath the outwardly facing groove and defines a bottom flexible annular wall portion or flap 45*c* on the bottom of the retaining ring or gasket. The flap 45*c* may be distorted by an operator for inserting the radially outer portion of the filter flange 130*d* in the groove 45*b* so that the filter means 130 is firmly supported within the receptacle 125 by the retaining ring 45.

It is thus seen that there is provided an improved receptacle means which aids in reduction of discharge of fine particles from the receptacle means with the air current produced by the traveling cleaner and wherein the improvement is embodied in a generally conical filter means disposed within the receptacle means for separating fiber waste from the air current and defining a surface of revolution about the central axis of the receptacle means such that the air current entering the receptacle means will be directed around the filter means and then through the filter means with the velocity of the air current being diminished and lowered as it passes through the filter means for effectively separating fiber waste from the air current passing through the receptacle means. It can also be seen that the invention provides a foam filter medium which cooperates with the filter means to further enhance the filtering of fine or submicron particles from the air current passing through the receptacle means.

In the drawings and specification there have been set forth preferred embodiments of the invention, and although specific terms are employed, they are used in a generic and descriptive sense only and not for purposes of limitation.

That which is claimed is:

1. In a traveling pneumatic cleaner for collection of fiber waste from a textile mill room and including fan housing means movable along a track over textile machines and having at least one air outlet portion thereon provided with an air discharge opening, a generally cylindrical fiber waste receptacle having a substantially vertically disposed generally cylindrical wall carried by the housing means and communicating therewith via the air discharge opening with the air discharge opening located near the upper end of the receptacle and being offset laterally with respect to the substantially vertical axis of the receptacle cylindrical wall, a suction inlet carried by and communicating with the fan housing means and adapted to receive therein fiber waste generated by the textile machines, and fan means for inducing flow of a suction air current into and through the suction inlet and the housing means and for directing fiber waste entrained in the air current through the discharge opening and into the receptacle as the air current is exhausted from the receptacle to the ambient; the combination therewith of an improvement which aids in the reduction of discharge of fine particles from the cleaner and comprising a filter means positioned in the receptacle and defining a surface of revolution so arranged relative to the laterally offset opening into the receptacle and relative to the cylindrical wall of the receptacle that the air current entering the receptacle will be directed around the outer surface of the filter means and then through the filter means with the velocity of the air current being diminished and lowered as it passes through the filter means.

2. Apparatus according to claim 1 wherein the receptacle cylindrical wall is provided with an open upper end and access door means for defining the bottom of the receptacle and adapted to be opened for removal of collected fiber waste from the receptacle, and said filter means is provided with an upper end fitted to the open upper end of the cylindrical wall such that said outer surface of the filter means extends about the substantially vertical axis of said cylindrical wall.

3. Apparatus according to claim 1 wherein said filter means comprises a filter body having a wall of relatively thin, rigid, foraminous sheet material, and a porous foam filter medium so positioned with respect to said wall that the air current flowing through said body wall also passes through said foam filter medium.

4. Apparatus according to claim 1 wherein said filter means includes a foam filter medium so positioned that the air current passes therethrough in its course through said filter means to the ambient.

5. Apparatus according to claim 1 wherein said filter means comprises a substantially vertically disposed generally conical body of relatively thin, rigid, foraminous sheet material defining said surface of revolution.

6. Apparatus according to claim 5 wherein said filter means further comprises a porous foam filter medium so positioned with respect to said conical body that the air current flowing through said conical body also flows through said foam filter medium.

7. Apparatus according to claim 5 wherein said filter means further comprises a porous foam filter medium positioned against the downstream surface of said conical body with respect to the direction of flow of the air current through said filter means.

8. Apparatus according to claim 7 wherein said foam filter medium is removably mounted in said conical body and is of preformed generally conical configuration to be self-sustaining in such configuration when removed from said conical body.

9. Apparatus according to claim 8 wherein said end closure member comprises a foraminous plate secured to the smaller end of said frusto-conical body.

10. Apparatus according to claim 1 wherein said filter means comprises a substantially vertically disposed foraminous frusto-conical filter body having a larger end and a smaller end with its smaller end facing downwardly within the receptacle, said smaller end of said filter body being spaced above the lower end of said receptacle, and an end closure member closing the smaller end of said filter body.

11. Apparatus according to claim 1 wherein said filter means comprises a substantially vertically disposed frusto-conical filter body of relatively thin, rigid, foraminous sheet material and having a larger end and a smaller end with its smaller end facing downwardly and spaced above the lower end of said receptacle, a porous foam filter medium of generally conical configuration adapted to be matingly received in said frusto-conical filter body and against said sheet material thereof, and means for releasably retaining said foam filter medium in said filter body.

12. Apparatus according to claim 11 wherein said foam filter medium is relatively thick and spongy, and wherein said means for releasably retaining said foam filter medium in said filter body comprises an annular flange axially of said filter body and being attached to said larger end thereof, said flange projecting radially inwardly from said frusto-conical filter body and having a lip portion thereon projecting generally axially inwardly from said flange, said lip portion being spaced inwardly from said sheet material of the body so that portions of said foam filter medium may be tucked manually between said sheet material and said lip portion to aid in releasably retaining said foam filter medium in said filter body.

13. In a traveling pneumatic cleaner for collection of fiber waste from a textile mill room and including fan housing means movable along a track over textile machines, a fiber waste receptacle carried by and communicating with the fan housing means and having a substantially vertically disposed cylindrical wall having an open upper end and access door means for defining the bottom of the receptacle and adapted to be opened for removal of collected fiber waste from the receptacle, a suction inlet carried by and communicating with the fan housing means and adapted to receive therein fiber waste generated by the textile machines, and fan means for inducing flow of a suction air current into and through the suction inlet and the housing means and for directing fiber waste entrained in the air current into the receptacle as the air current is exhausted from the receptacle; the combination therewith of an improvement which aids in the reduction of discharge of fine particles from the cleaner and comprising a filter means positioned in the receptacle and defining a surface of revolution, said filter means having an upper end fitted to the open upper end of the cylindrical wall such that the surface of said filter means extends about the substantially vertical central axis of the cylindrical wall, and the receptacle communicating with the fan housing means via an air outlet portion on the fan housing means which is communicatively connected with the upper portion of the cylindrical wall in offset relation to said vertical axis thereof and adjacent and below the upper end of the filter means so that the air current entering the receptacle will be directed around the outer surface of the filter means.

14. In a traveling pneumatic cleaner for collection of fiber waste from a textile mill room and including fan housing means movable along a track over textile machines, a fiber waste receptacle carried by and communicating with the fan housing means and having a substantially vertically disposed cylindrical wall having an open upper end and access door means for defining the bottom of the receptacle and adapted to be opened for removal of collected fiber waste from the receptacle, a suction inlet carried by and communicating with the fan housing means and adapted to receive therein fiber waste generated by the textile machines, and fan means for inducing flow of a suction air current into and through the suction inlet and the housing means and for directing fiber waste entrained in the air current into the receptacle as the air current is exhausted from the receptacle; the combination therewith of an improvement which aids in the reduction of discharge of fine particles from the cleaner and comprising a filter means positioned in the receptacle and defining a surface of revolution, said filter means having an upper end fitted to the open upper end of the cylindrical wall such that the surface of said filter means extends about the substantially vertical central axis of the cylindrical wall, the receptacle communicating with the fan housing means via an air outlet portion on the fan housing means which is communicatively connected with the upper portion of the cylindrical wall in offset relation to said vertical axis thereof and adjacent and below the upper end of said filter means so that the air current entering the receptacle will be directed around the outer surface of the filter means, and baffle means extending substantially radially outwardly from said filter means toward the cylindrical wall and being disposed adjacent and downstream of the air outlet portion of the fan housing means and also being positioned to one side of the air outlet portion such as to aid in directing the air current from the outlet portion in a generally circular path about the surface of the filter means while restricting the velocity of any cyclonic air current thereabout.

15. In a traveling penumatic cleaner for collection of fiber waste from a textile mill room and including fan housing means movable along a track over textile machines, a fiber waste receptacle having a substantially vertical axis and carried by and communicating with the fan housing means, a suction inlet carried by and communicating with the fan housing means and adapted to receive therein fiber waste generated by the textile machines, and fan means for inducing flow of a suction air current into and through the suction inlet and the housing means and for directing fiber waste entrained in the air current into the receptacle as the air current is exhausted from the receptacle; the combination therewith of an improvement which aids in the reduction of discharge of fine particles from the cleaner and comprising a filter means positioned in the receptacle and defining a surface of revolution, the receptacle communicating with the fan housing means via an air outlet portion on the fan housing means which is communicatively connected with the upper portion of the receptacle in offset relation to said vertical axis thereof and adjacent and below the upper end of the filter means so that the air current entering the receptacle will be directed around the outer surface of the filter means, said filter means comprising a substantially vertically disposed foraminous frusto-conical filter body having a larger end and a smaller end with its smaller end facing downwardly within the receptacle, said smaller end of said filter body being spaced above the lower end of the receptacle, and end closure member closing the smaller end of said filter body, and baffle means extending substantially radially between said frusto-conical body and the inner surface of the receptacle and being positioned adjacent and to one side of the air outlet portion such as to aid in directing the air current in a generally circular path about said filter body.

16. In a traveling penumatic cleaner for collection of fiber waste from a textile mill room and including fan housing means movable along a track over textile machines, a fiber waste receptacle having a substantially vertical axis and carried by and communicating with the fan housing means, a suction inlet carried by and communicating with the fan housing means and adapted to receive therein fiber waste generated by the textile machines, and fan means for inducing flow of a suction air current into and through the suction inlet and the housing means and for directing fiber waste entrained in the air current into the receptacle as the air current is exhausted from the receptacle; the combination therewith of an improvement which aids in the reduction of discharge of fine particles from the cleaner and comprising a filter means positioned in the receptacle and defining a surface of revolution, the receptacle communicating with the fan housing means via an air outlet portion on the fan housing means which is communicatively connected with the upper portion of the receptacle in offset relation to said vertical axis thereof and adjacent and below the upper end of the filter means so that the air current entering the receptacle will be directed around the outer surface of the filter means, said filter means comprising a substantially vertically disposed foraminous frusto-conical filter body having a larger end and a smaller end with its smaller end facing downwardly within the receptacle, said smaller end of said filter body being spaced above the lower end of the receptacle, an end closure member closing the smaller end of said filter body, substantially right-triangular configuration baffle means extending substantially radially between said frusto-conical body and the inner surface of the receptacle and being positioned adjacent and to one side of the air outlet portion such as to aid in directing the air current in a generally circular path about said filter body, and means for detachably securing said baffle means to said frusto-conical filter body to facilitate storing a plurality of said frusto-conical bodies in nesting relationship before assembling the same in respective receptacles.

17. A filter means for use in a fiber waste collection receptacle of a traveling pneumatic cleaner for textile rooms and comprising a generally conical filter body of relatively thin, rigid, foraminous sheet material, a porous foam filter medium of generally conical configuration adapted to be matingly received in said conical filter body and against said sheet material thereof, and means for releasably retaining said foam filter medium in said filter body.

18. A filter means as claimed in claim 17 wherein said foam filter medium is relatively thick and spongy, and wherein said means for releasably retaining said foam filter medium in said filter body comprises an annular flange attached to the larger end of and projecting radially inwardly from said conical filter body, a lip portion on and projecting generally axially inwardly from said flange and being spaced inwardly from said body sheet material so that portions of said foam filter medium may be tucked between said body sheet material and said lip portion for retaining said foam filter medium in said filter body.

* * * * *